US006367354B1

(12) United States Patent
Mitchell

(10) Patent No.: US 6,367,354 B1
(45) Date of Patent: Apr. 9, 2002

(54) DUAL ANALOG AND RATCHET WRENCH

(76) Inventor: M. Todd Mitchell, 1154 N. 2925 West, Layton, UT (US) 84041

( * ) Notice: Subject to any disclaimer, the term of this patent is extended or adjusted under 35 U.S.C. 154(b) by 0 days.

(21) Appl. No.: 09/658,129

(22) Filed: Sep. 8, 2000

Related U.S. Application Data

(63) Continuation-in-part of application No. 09/533,890, filed on Mar. 22, 2000, which is a continuation-in-part of application No. 09/065,806, filed on Apr. 23, 1998, now Pat. No. 6,055,888.

(51) Int. Cl.[7] ..... B25B 13/00
(52) U.S. Cl. ..... 81/59.1; 81/63.1; 81/59.39
(58) Field of Search ..... 81/59.1, 63.1, 81/59.39, 60, 61, 62, 63.2; 192/44, 38

(56) References Cited

U.S. PATENT DOCUMENTS

| | | | | |
|---|---|---|---|---|
| 2,989,160 A | | 6/1961 | Woodruff | |
| 3,590,667 A | | 7/1971 | Berglein | |
| 3,621,739 A | | 11/1971 | Seablom | |
| 3,679,031 A | | 7/1972 | Stephens | |
| 3,752,277 A | | 8/1973 | Nakai | |
| 4,429,598 A | | 2/1984 | Tucker | |
| 4,485,700 A | | 12/1984 | Colvin | |
| 4,520,697 A | | 6/1985 | Moeteeli | |
| 4,631,988 A | | 12/1986 | Colvin | |
| 4,903,554 A | | 2/1990 | Colvin | |
| 4,987,803 A | | 1/1991 | Chern | |
| 5,165,509 A | | 11/1992 | Kanno et al. | |
| 5,178,047 A | | 1/1993 | Arnold et al. | |
| 5,235,878 A | * | 8/1993 | Young | 81/53.2 |
| 5,582,080 A | | 12/1996 | Barmore | |
| 5,596,913 A | | 1/1997 | Matsubara et al. | |
| 5,630,342 A | | 5/1997 | Owoc | |
| 5,697,267 A | | 12/1997 | Tsai | |
| 5,709,137 A | | 1/1998 | Blacklock | |
| 6,055,888 A | * | 5/2000 | Mitchell | 81/59.1 |
| 6,164,167 A | * | 12/2000 | Chen | 81/63.2 |
| 6,237,447 B1 | * | 5/2001 | Chen et al. | 81/63.1 |

* cited by examiner

*Primary Examiner*—Joseph J. Hail, III
*Assistant Examiner*—Lee Wilson
(74) *Attorney, Agent, or Firm*—Thorpe North & Western

(57) ABSTRACT

A wrench device has a bearing-type clutch for providing a unidirectional rotational force and an opposite unidirectional independent rotation. The wrench device includes both a bearing-type engagement for use at lower torques, and a ratchet pawl for use at higher torques. The bearing is disposed in an irregular space between a primary wall of a primary body and a secondary wall of a secondary body. The space has tapering or narrowing sections in which the bearing binds to fixedly engage the primary and secondary bodies as the primary body rotates in a first rotational direction. A pin or toggle dislodges the bearings so that the primary body may rotate freely in a second, opposing rotational direction while another bearing binds the secondary body to the primary body when the primary body is rotated in the first rotational direction. Alternatively, the bearings are selectively positioned in the space to cause the primary and secondary to rotate together or independently depending on the positioning of the bearing and the rotational direction of the primary body.

31 Claims, 10 Drawing Sheets

DUAL ANALOG AND RATCHET WRENCH

This application is a continuation-in-part of co-pending U.S. patent application Ser. No. 09/533,890 filed Mar. 22, 2000, which is a continuation-in-part of U.S. Ser. No. 09/865,806 U.S. Pat. No. 6,055,888, filed Apr. 23, 1998, and issued May 2, 2000.

BACKGROUND OF THE INVENTION

1. The Field of the Invention

The present invention relates generally to a wrench with a bearing-type clutch and/or a ratchet type mechanism. In particular, the present invention relates to a wrench with both instant engagement bearings and higher torque pawl and ratchet gears.

2. The Background Art

Various types of fasteners are used to attach two or more members together. A bolt and nut combination is one type of well known fastener. The bolt includes a male threaded end configured to engage a female threaded nut.

The driving end of the bolt, or the head, and the nut are provided with bodies of standard size and shape. The most common shape is a hexagon, or six-sided body. Other shapes are available, including a square. The head may also be provided with a hole or bore of standard size and shape. Such shapes include various stars with straight and curved sides and various polygons. In addition, such heads and nuts are provided in English and metric size ranges, such as ⅛ in., 3⁄16 in., ¼ in., 5⁄16 in., ⅜ in., etc., or 3 mm, 4 mm, 5 mm, 6 mm, etc.

Special tools are configured to engage and drive either the head of the bolt and/or the nut. For example, a wrench typically has an open-ended jaw and a closed-ended jaw. The ends are sized and configured to mate with the bolt head or nut. Thus, wrenches typically have apertures formed in the ends with various polygonal shapes, or stars with various numbers of points. In addition, the wrenches are usually provided in sets having numerous wrenches each having jaws configured to mate with a particularly sized bolt head or nut. By engaging the bolt head or nut with the appropriate wrench, the bolt or nut may be rotated clockwise or counterclockwise in order to tighten or loosen the fastener, respectively.

One problem with the above described wrenches is that they often must be continually disengaged and re-engaged with the nut or bolt. Often, a fastener is placed adjacent another member or located in a limited space. Because the wrench has an elongated body, it may be turned only a fraction of the necessary rotation before any further rotation is impeded. Thus, the wrench must be disengaged from the head, rotated back to the starting point, re-engaged with the head, rotated until again impeded, and the process repeated until the fastener is either loosened or tightened. In addition, if the head is located where only a small rotation is possible, the wrench must also be turned over after disengaging because the handle extends at an angle from the end of the wrench. Furthermore, if the space is extremely tight, the wrench may be rendered useless because there is insufficient space in which the wrench may turn the head.

A ratchet wrench is very popular and solves many of the above identified problems with the standard wrench. The ratchet wrench has a ratchet mechanism which allows a handle of the wrench to rotate freely in one direction, but engage a driver coupled to a head of the ratchet wrench in the opposite direction. This allows the ratchet wrench to engage a head, and rotate back and forth, tightening or loosening the fastener without having to disengage the wrench from the head. The typical ratchet wrench has an elongated body with a head adapted to receive sockets of various sizes and shapes. Thus, sockets usually are provided in sets with one or more ratchet wrenches. The ratchet wrench typically has a set of teeth and a pawl which reversibly engage in one direction.

One problem with the ratchet wrench is the finite increments the wrench may be rotated backwards, known as arc swing. Conventional ratchet wrenches have a finite number of engagement points and are therefore limited in the degree they may be rotated backwards, or arc swing, by the number of the teeth. For example, if there are 60 teeth, the ratchet wrench is limited to 6 degree increments when rotating backwards before another tooth can be engaged. If the head of the bolt is located in a tight space, it may not be possible to rotate the ratchet wrench a full 6 degrees. Thus, the wrench will not be able to rotate back more than the 6 degrees to engage the next tooth, rendering the wrench useless.

Analog or bearing-type wrenches have been developed and may provide smaller arc swing, and thus may be utilized in very tight spaces. These analog or bearing-type wrenches, however, may roll under high torque conditions.

SUMMARY OF THE INVENTION

It has been recognized that it would be advantageous to develop a wrench with an infinite number of engagement points, or a wrench that instantly engages despite the amount of backwards rotation. In addition, it has been recognized that it would be advantageous to develop a wrench with a small arc swing, and capable of withstanding high torque conditions. It also has been recognized that it would be advantageous to develop such a wrench capable of operation in both directions, or a reversible wrench. It also has been recognized that it would be advantageous to develop a reversible clutch capable of instantaneous engagement and with infinite increments in the reverse direction.

The invention provides a wrench device having a bearing clutch with a small arc swing, and a ratchet mechanism capable of withstanding high torque. The wrench includes a secondary body or engagement cam rotatably coupled to a primary body having a handle and head. The primary body has a cavity forming a primary wall. The secondary body can be rotatably disposed in the cavity, and has a secondary wall generally opposing the primary wall.

A tapering space is formed between the primary and secondary walls. A bearing is movably disposed in the tapering space and movably between a free location and an binding location. In the free location the bearing allows the secondary body to rotate with respect to the primary body. In the binding location the bearing binds between the primary and secondary walls to cause the primary and secondary bodies to rotate together.

A plurality of teeth also are formed on one of the primary or secondary bodies, such as in the cavity of the primary body. A pawl is pivotally disposed on the other of the primary or secondary bodies, such as the secondary body, to engage the plurality of teeth. The pawl can pivot between a slip position and an engagement position. In the slip position the teeth slide past the pawl to allow the secondary body to rotate with respect to the primary body. In the engagement position the pawl engages in the teeth to cause the primary and secondary bodies to rotate together.

Preferably, the bearing clutch has a small arc swing relative to an arc swing of the ratchet mechanism. In addition, the bearing binds between the primary and secondary walls in the binding location when a torque is applied between the primary and secondary bodies, but may roll when an increased torque is applied. The pawl advantageously engages the teeth in the engagement position when the increased torque is applied to prevent further rotation.

In accordance with one aspect of the present invention, the cavity of the primary body further includes a smooth wall section, and a toothed section with the plurality of teeth. Both sections preferably circumscribe the cavity. Similarly, the secondary body can include a smooth wall section opposing the smooth wall section of the primary body and circumscribing the secondary body.

In accordance with another aspect of the present invention, the wrench can include displacement means for displacing the bearing from the binding location to the free location. For example, a switch or pivot member can be pivotally coupled to the primary body, and a swivel link can be pivotally coupled to the secondary body and engaged by the switch or pivot member to displace the bearings.

In accordance with another aspect of the present invention, the at least one pawl can include at least two pawls which are disposed to abut the teeth such that the pawls alternately abut the teeth. A first pawl can abut the teeth at a first rotational orientation between the bodies. A second pawl can abut the teeth in a second rotational orientation between the bodies. Thus, each single pawl abuts the teeth at rotational intervals equaling 360 degrees divided by the number of teeth, but the pawls together abut the teeth at rotational intervals equaling at least half of a single pawl, reducing the arc swing and decreasing any roll of the bearing at increased torque.

Additional features and advantages of the invention will be set forth in the detailed description which follows, taken in conjunction with the accompanying drawing, which together illustrate by way of example, the features of the invention.

DETAILED DESCRIPTION

Figure 1:
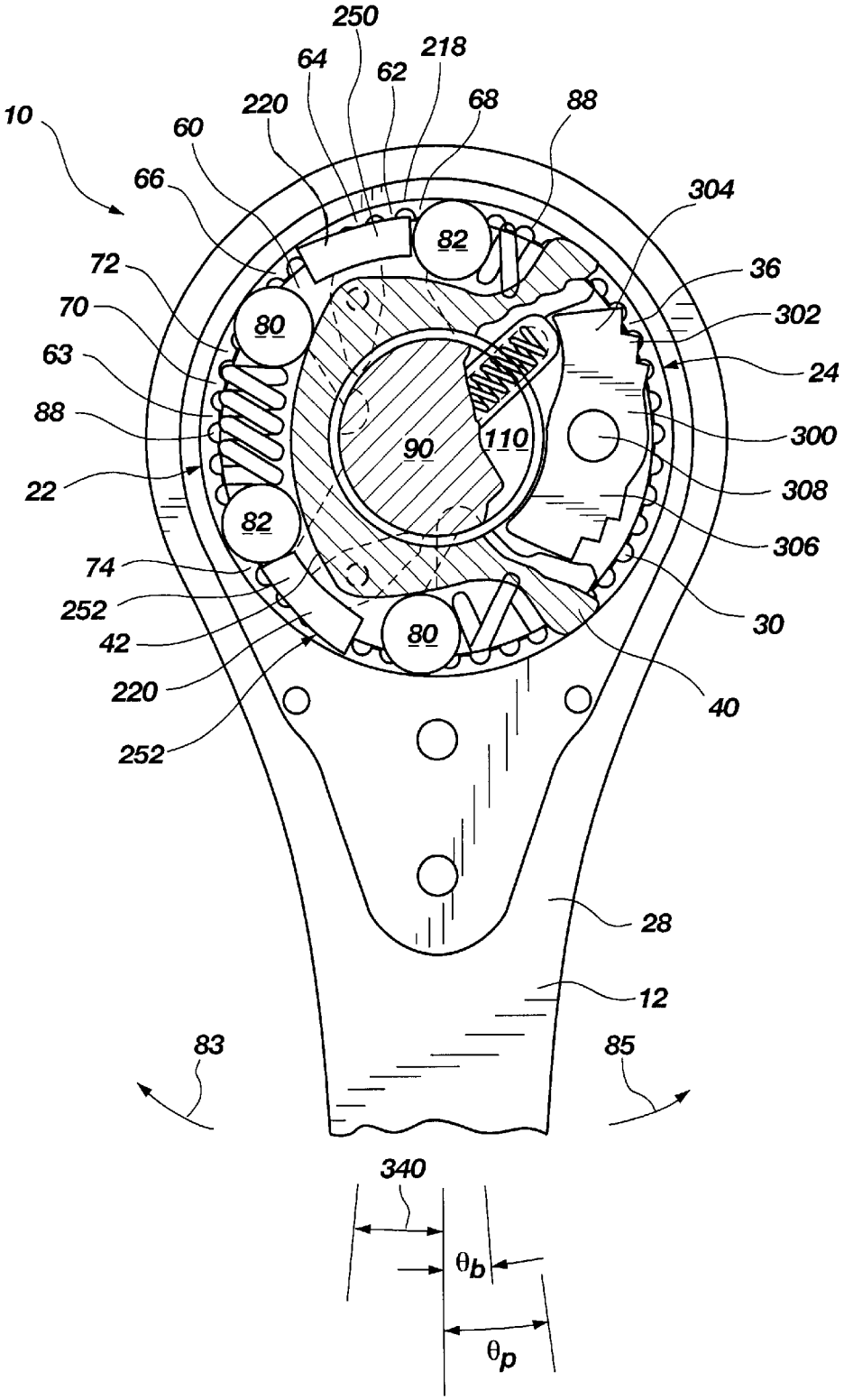
FIG. 1 is a bottom, break-away view of a wrench device in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 4:
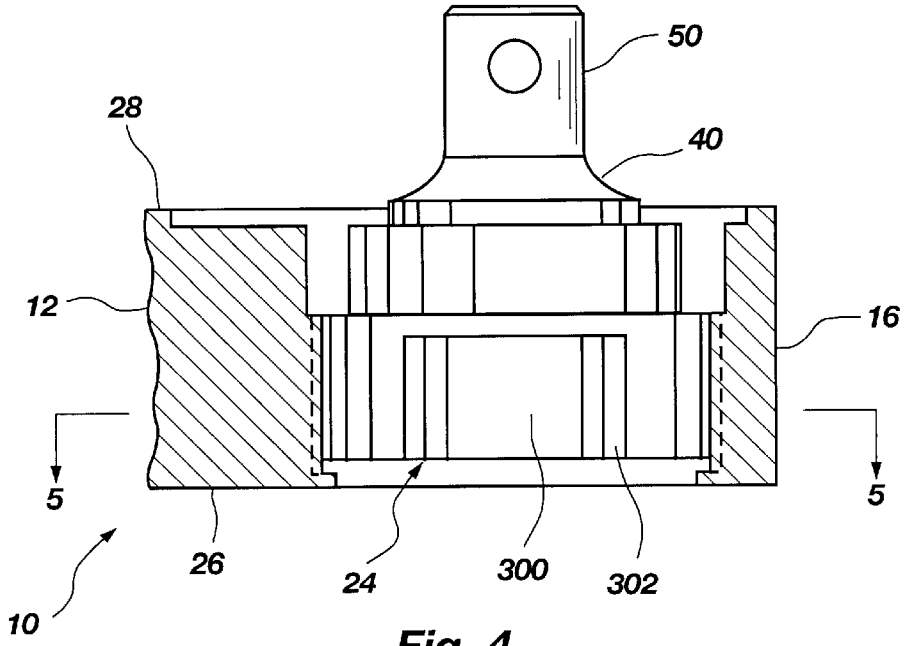
FIG. 4 is a side, break-away view of the wrench device of FIG. 1.
Figure 5:
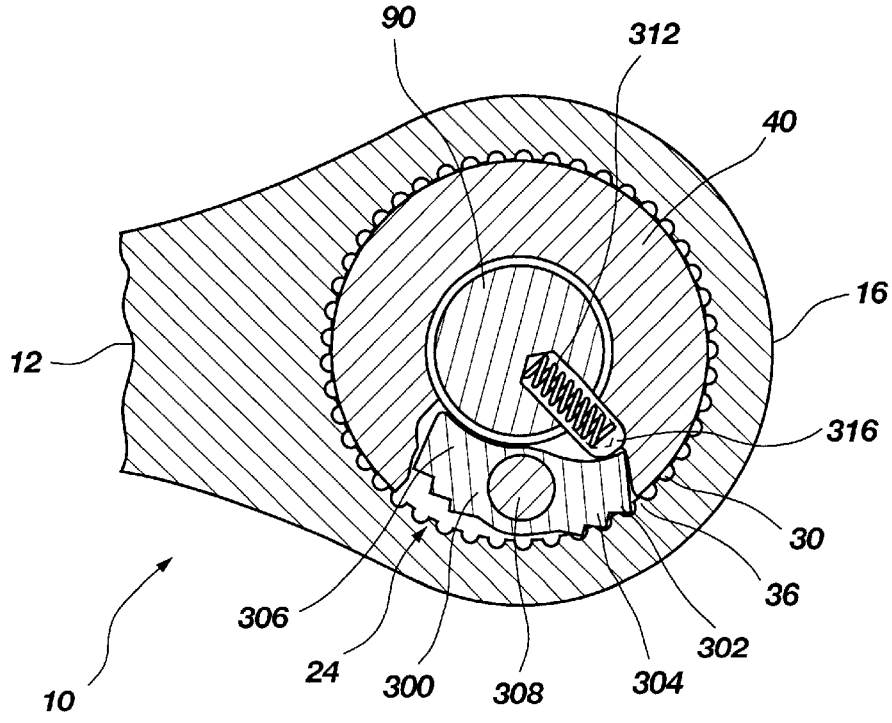
FIG. 5 is a bottom, cross-sectional view of the wrench device of FIG. 1 taken along line 5—5.
Figure 6:
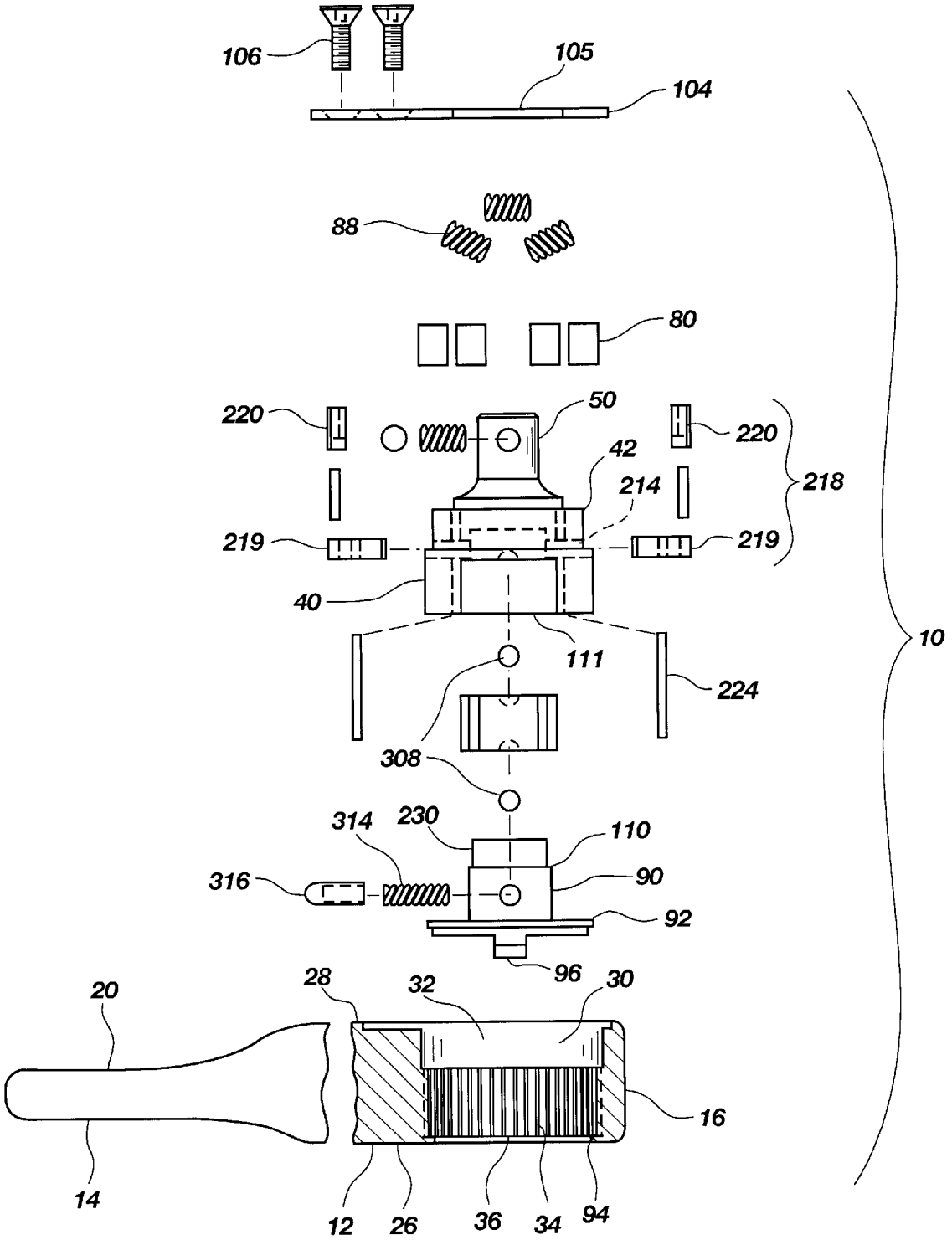
FIG. 6 is an exploded view of the wrench device of FIG.

Referring to FIGS. 1–6, a wrench device, indicated generally at 10, of the present invention is shown which advantageously includes both a bearing-type clutch 22 with a small arc swing $\theta_b$, and a ratchet mechanism 24 capable of withstanding large torque, as discussed more fully below. The wrench device 10 has an elongated main or primary body 12 with proximal and distal ends 14 and 16, as shown in FIG. 6. A handle 20 is formed on the proximal end 14 of the main body 12 for a user to grasp, again as shown in FIG. 6. The distal end 16 defines a head for engaging and driving a socket or a fastener. Although only the head portion 16 of the wrench device 10 is shown in many of the drawings, the elongated body and handle portion of the wrench device are well known in the art for providing leverage and grip.

The wrench device 10 advantageously has both a reversible, bearing-type clutch, indicated generally at 22, and a ratchet-type mechanism, indicated generally at 24, for reversibly and selectively providing a rotational force in one direction, and free or independent rotational movement in the other direction, as discussed in greater detail below. Various aspects of the bearing-type clutch 22 are described in U.S. Pat. No. 6,055,888 and U.S. patent application Ser. No. 09/533,890, which are herein incorporated by reference.

The wrench device 10 may drive or loosen a fastener (not shown). As used herein, the term "fastener" is used broadly to indicate any type of device for fastening, particularly a type requiring rotational motion to operate. Specifically, the term "fastener" includes at least a bolt or a nut. Typically, nuts and bolts are characterized by hexagonally shaped bodies or heads. Alternatively, other shaped bodies are also included in the term "fastener." In addition, variously shaped indentations or cavities may be formed in the bodies. To accommodate these various types of fasteners, corresponding or mating "sockets" have been developed to engage the fasteners. The term "socket" is also used broadly herein to indicate any device which engages a "fastener." Fasteners and sockets are well known in the art. Thus, the head portion 16 of the wrench device 10 engages and drives the fastener and socket (not shown).

Figure 2:
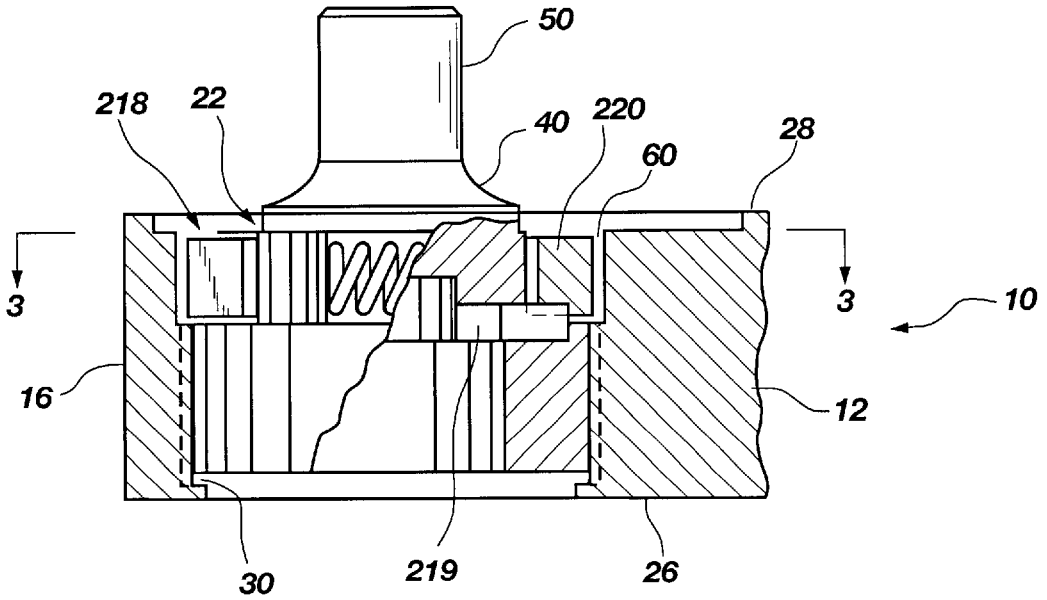
FIG. 2 is a side, break-away view of the wrench device of FIG. 1.
Figure 7B:
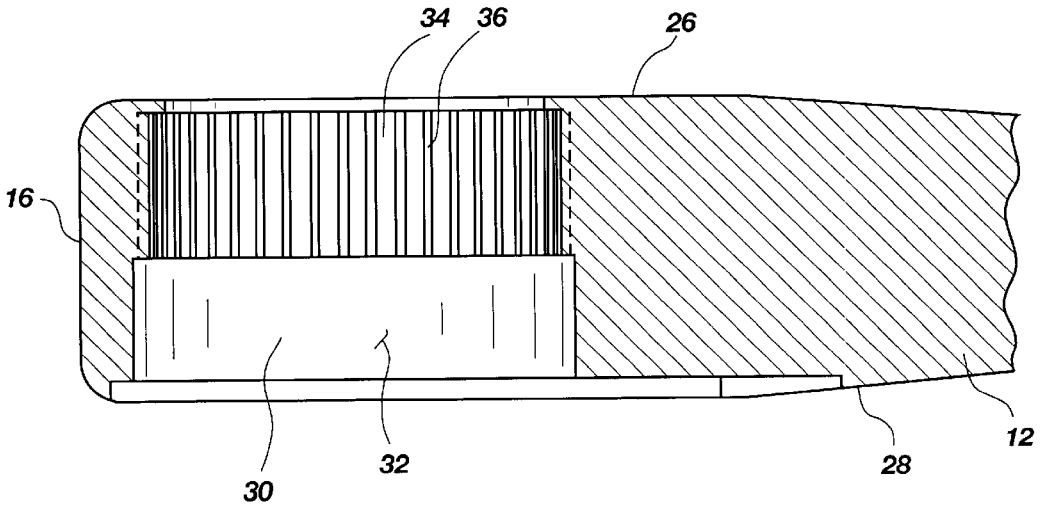
FIG. 7*b* is a cross-sectional side view of the handle or primary body of FIG. 7*a,* taken along line 7*b*—7*b*.
Figure 7A:
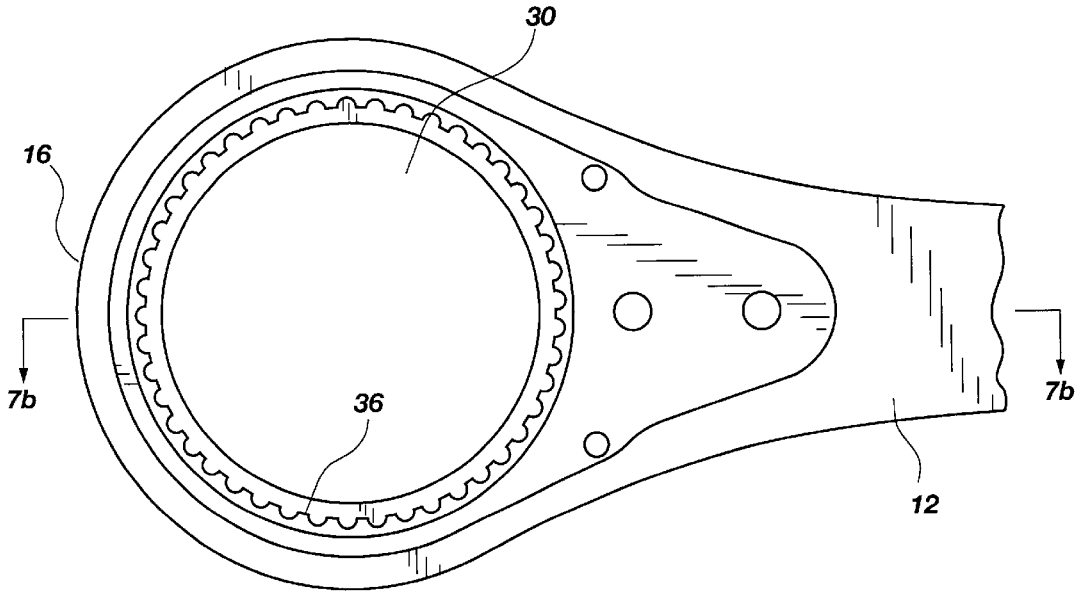
FIG. 7*a* is a bottom view of a handle or primary body of the wrench device in accordance with the present invention.
Figure 8C:
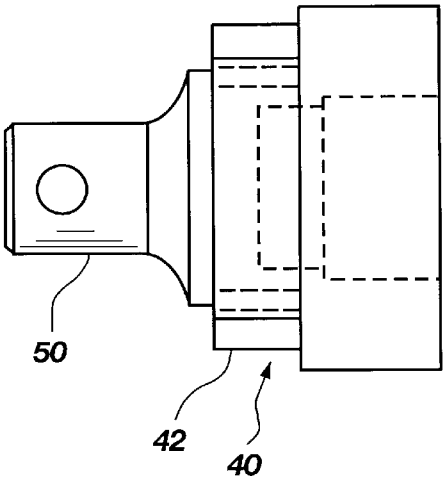
FIGS. 8*a* and 8*c* are side views of an engagement cam or secondary body of the wrench device in accordance with the present invention.
Figure 8B:
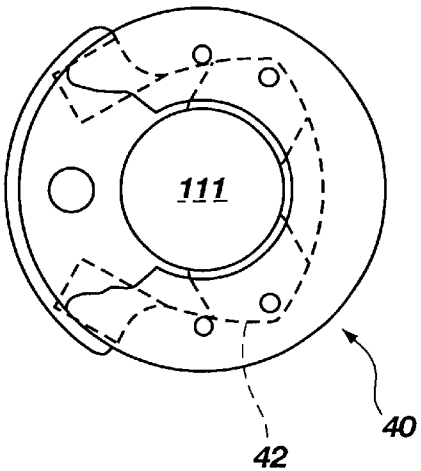
FIG. 8*b* is a top view of the engagement cam or secondary body of FIG. 8*a;*
Figure 8A:
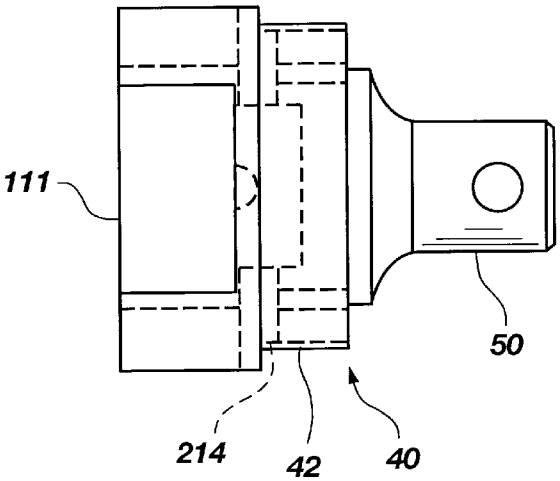

The head 16 or primary body 12 has an upper side 26 and a lower side 28, as shown in FIGS. 2 and 4. A cavity 30 is formed in the head 16 of the primary body 12 which may extend through the head 16 from the upper side 26 to the lower side 28, as shown in FIGS. 6, 7*a* and 7*b*. Thus, the cavity 30 is formed transverse to the longitude of the body 12 and the upper and lower sides 26 and 28.

Referring to FIG. 7*a,* the cavity 30 or primary body 12 has a primary wall or smooth wall section 32 preferably circumscribing the cavity 30. The cavity 30 and cavity wall 32 are circular or cylindrical, but may be another shape as discussed more fully below. In addition, the cavity 30 may have sections of various diameters, or annular indentations and annular projections or flanges, as discussed more fully below.

In addition, the cavity 30 or primary body has a toothed section 34 with a plurality of teeth 36 preferably circumscribing the cavity 30. The teeth 36 may be formed by a plurality of indentations formed in the cavity wall, and/or a plurality of protrusions extending from the cavity wall. The number of teeth 36 may vary, and determine the arc swing $\theta_p$ of the wrench 10 when the ratchet mechanism 24 is used. For example, forty-five teeth 36 may be used, as shown, for an arc swing $\theta_p$ of the ratchet mechanism 24 of 8 degrees. It is of course understood that any number of teeth may be used resulting in various degrees of arc swing $\theta_p$ for the ratchet.

Referring again to FIGS. 1–6, the wrench device 10 also has an engagement cam or secondary body 40 rotatably coupled to the primary body 12. The secondary body 40 is disposed in the cavity 30 of the primary body 12. The cam or secondary body 40 has a cam or secondary wall 42, or drive wall. The secondary wall 42 and the primary wall 32 face each other, or are generally opposing one another. The secondary body 40 and secondary wall 42 may be circular or cylindrical, but may be another shape as discussed more fully below. In addition, the secondary body 40 may have sections of various diameters, or annular indentations and annular projections or flanges, as discussed more fully below.

A drive member 50 is disposed on the secondary body 40 for engaging and driving a socket (not shown). The drive member 50 and secondary body 40 may be integrally formed. The drive member 50 is sized and configured to engage a cavity of a socket. The drive member 50 may be a protrusion with a standard size and shape configured for engaging a cavity of a standard size and shape in the socket. Thus, the drive member 50 typically will be a protrusion with a square cross section sized for standard socket cavities.

The drive member 50, or the drive member 50 and secondary body 40, is one example of a driving means for coupling to and driving a fastener or socket. It is of course understood that other drive means for coupling to and driving fasteners and/or sockets are available and include, for example, an integral cam and drive member, a drive member and socket, and integral drive member and socket, etc.

For purposes of explaining the operation of the wrench, it will be noted that FIGS. 1, 3, 5, 10 and 11 show the wrench oriented with the bottom or lower surface 28 facing the viewer or out of the page, such that the driver member 50 would face out of the page, and such that rotational movement of the secondary body 40 or drive member 50 in the clockwise direction 83 would loosen a typical fastener, while rotational movement in the counter-clockwise direction 85 would tighten a standard fastener. Thus, clockwise rotation 83 of either body 12 or 40 may be considered in a reverse direction, while counter-clockwise rotation 85 may be considered in a forward direction. Typically, a right handed thread is used. It is of course understood that if a left handed thread is used then the rotational directions for tightening and loosening must be reversed.

A space 60 is formed between the secondary wall 42 and the primary wall 32, or between the primary body 12 and the secondary body 40. The space 60 advantageously has a nonuniform or uneven width, or tapers, the purpose of which is discussed more fully below. The shape or width of the space 60 is determined by the shape of the cavity 30 and the shape of the secondary body 40. As indicated above, the primary wall 32 may be circular while the secondary wall 42 is non-circular, as shown, thus forming a nonuniform space 60. Alternatively, the primary wall 32 may be non-circular while the secondary wall 42 is circular. In addition, both the primary wall 32 and the secondary wall 42 may be non-circular, or uneven.

The variation in the wall 32 and 42 or body 12 and 40 shapes is to create a nonuniform space 60 there between, or a space 60 with varying distances between the opposing walls 32 and 42, or a space 60 with walls 32 and 42 that taper towards and/or away from one another. The tapering walls create one or more narrowing sections within the space 60. The non-circular walls may be formed of various arcs or straight lines. The nonuniform space 60 is configured and dimensioned to cause the primary body 12 to rotate independently with respect to the secondary body 40 in one rotational direction, and to cause the primary body and secondary body 40 to engage and rotate together in another rotational direction, as discussed more fully below.

The space 60 may be annular or ring-like, with one or more narrowing sections. Conceptually, the space 60 may be viewed as being comprised of several, arc-like, component spaces 62 and 63, each having opposing narrowing ends or sections, disposed end-to-end to form a larger annular space. The narrowing ends or sections narrow in opposing directions and may narrow towards the component space or away from the component space. The component spaces 62 may have a narrow center section 64 and narrowing ends 66 and 68 that narrow towards the center section 64, or widen away from the center section. The space 62 has a first narrowing section 66 defining a reverse end or section, and a second narrowing section 68 defining a forward end or section.

Alternatively, the component spaces 63 may have a wider center section 70 and narrowing ends 72 and 74 that narrow away from the center section 70, or widen towards the center section. The space 63 has a first narrowing section 72 defining a reverse end or section and a second narrowing section 74 defining a forward end or section. It will be appreciated that when the component spaces 62 or 63 are arranged annularly, the component spaces 62 or 63 may be conceptually viewed as either wide spaces with narrow ends or narrow spaces with wide ends, as described above. However, if only a single component space 62 or 63 is used, either type of space 62 or 63 may be used.

A pair of engagement bearings 80 and 82 are disposed in the space 60 between the primary wall 32 and the secondary wall 42. The bearings are positioned and dimensioned to bind in the narrowing ends 66 and 68 or 72 and 74 to engage the primary body 12 with the secondary body 40. A first bearing 80 defines a reverse bearing and is disposed closer to the first, or reverse, narrowing end 66 or 72 than the forward section. A second bearing 82 defines a forward bearing and is disposed near the second, or forward, narrowing end 68 or 74 than the reverse end.

The bearings 80 and 82 selectively bind, or are selectively allowed to bind, in the reverse and narrowing ends 66 and 72, and 68 and 74. In addition, the bearings 80 and 82 can be selectively displaced to prevent them from binding. By selectively positioning the bearings 80 and 82, the wrench device 10 can be selectively controlled, or can selectively exert torque in one direction while turning freely in the other direction.

The reverse bearing 80 binds between the primary wall 32 and the secondary wall 42 as the primary body 12 rotates with respect to the secondary body 40 in a first rotational direction, or in a reverse rotational direction, indicated by the arrow 83. The reverse bearing 80 causes the secondary body 40, and thus the drive member 50, to engage and rotate with the primary body 12 in the reverse rotational direction 83. The forward bearing 82 may be displaced, or prevented from binding, so that the primary body 12 can rotate freely with respect to the secondary body 40 in the opposite direction 85.

Similarly, the forward bearing 82 binds between the primary wall 32 and the secondary wall 42 as the primary body 12 rotates with respect to the secondary body 40 in a second rotational direction, or in a forward rotational direction, indicated by the arrow 85. The forward bearing 82 causes the secondary body 40, and thus the drive member 50, to engage and rotate with the primary body 12 in the forward rotational direction 85. The reverse bearing 80 may be displaced, or prevented from binding, so that the primary body 12 can rotate freely with respect to the secondary body 40 in the opposite direction 83.

Springs 88 are disposed in the space 60 for biasing the bearings 80 and 82 towards the narrowing ends or sections 66 and 68 or 72 and 74 of the space 62 or 63. A single spring 88 may be disposed between the bearings 80 and 82 and in the wider center 70 of the space 63. Alternatively, a pair of springs 88 may be disposed on both ends of the bearing pair. The spring is one example of a biasing means for biasing the bearings towards the narrowing ends. It is of course understood that other biasing means are available and include, for example, a rubber member, a pressure differential, etc.

A pivot member or switch 90 is pivotally coupled to the head 16 of the primary body 12. Preferably the pivot member 90 is at least partially disposed in the cavity 30. The pivot member 90 has an annular flange 92 that abuts an annular projection 94 formed on the upper side 26 of the head 16 at the cavity 30 for maintaining the pivot member 90 to the head 16. One or more tabs 96 are formed on the pivot member 90 and project therefrom for a user to grip. The tabs 96 are one example of a grip means for being gripped by a user to pivot the pivot member 90.

A plate 104 is disposed over the cavity 30 to maintain the secondary body 40 and bearings 80 and 82 in the cavity 30. A hole 105 is formed in the plate 104 through which the drive member 50 extends. Screws 106 or other fasteners may be used to secure the plate 104 to the primary body 12. A projection 110 is formed on the pivot member 90 and extends into a cavity 111 of the secondary body 40. The switch 90 selectively displaces the bearings 80 and 82 to control the engaging and free directions of the primary and secondary bodies 12 and 40. The switch 90 acts to displace or dislodge the bearings 80 and 82 from the narrowing ends 66 and 68 or 72 and 74. Thus, the switch 90 prevents one of either the forward or reverse bearings 80 and 82 from binding in the narrowing end between the primary body 12 and the secondary body 40.

Referring to FIGS. 6 and 8*a*–8*c*, a radial bore 214 is formed in the secondary body 40 and extends radially from the longitudinal hole 111 to the secondary wall 42. The bore 214 terminates at the secondary wall 42 near the narrow ends 66 and 68 of the space 62, or at the narrower center 64. One or more radial bores 214 may be formed in the secondary body 40, as shown.

A toggle 218 is coupled to the secondary body 40, and engaged by the switch 90, to displace the bearings 80 and 82. The toggle 218 includes a swivel link 219 and a pusher member 220. The toggle 218 is pivotally disposed in the radial bore 214. The pusher member 220 is disposed in the space 62 for engaging the bearings 80 and 82. A pivot pin 224 extends through the secondary body 40, radial bore 214, and toggle 218 about which the toggle pivots.

Figure 9C:
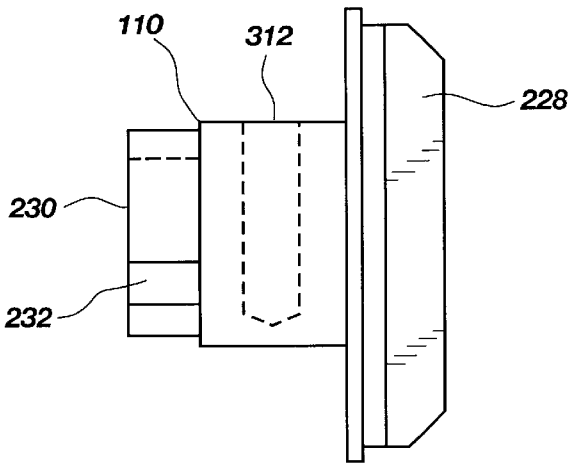
FIGS. 9*a* and 9*c* are side views of a switch of the wrench device in accordance with the present invention.
Figure 9B:
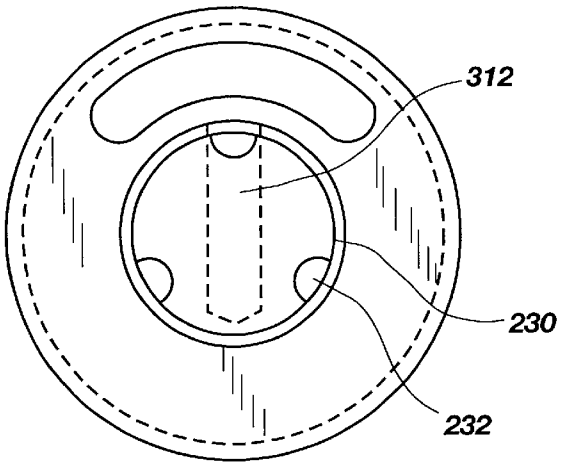
FIG. 9*b* is a bottom view of the switch of FIG. 9*a;*
Figure 9A:
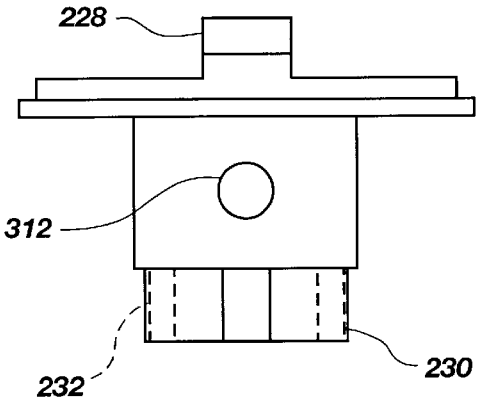

Referring to FIGS. 9*a*–9*c*, the pivot member or switch 90 has a grip portion 228 for being gripped by a user and a cam portion 230. The cam portion 230 of the pivot member 90 extends into, or is received within, the longitudinal hole 111 of the secondary body 40. An indentation 232 is formed in the cam portion 230 for operatively engaging or coupling the pivot member 90 and the toggle 218. The indentation 232 receives an end of the toggle 218 opposite the pusher member 220. Thus, as the pivot member 90 and cam portion 230 pivot, the engagement between the indentation 232 and the end of the toggle 218 causes the toggle 218 to pivot.

Referring again to FIG. 1, as the pivot member 90, and thus the cam portion 230, is pivoted in a first pivot direction (counterclockwise in FIG. 1) the toggle 218 pivots in a first toggle direction (clockwise in FIG. 1) opposite that of the pivot direction. As the toggle 218 pivots in the first toggle direction, the pusher member 220 of the toggle contacts and dislodges the forward bearing 82 from the forward narrowing ends 68 or 74 of the spaces 62 or 63. Thus, the forward bearing 82 is prevented from binding by the toggle 218.

As the primary body 12 is rotated with respect to the secondary body 40 in the second rotational direction 85, it rotates independently of the secondary body 40, or rotates freely, because the toggle 218 prevents the forward bearing 82 from binding. As the primary body 12 is rotated with respect to the secondary body 40 in the first rotational direction 83, the reverse bearing 80 binds in the reverse ends 66 or 72 of the spaces 62 or 63 between primary and secondary walls 32 and 42. Thus, the primary and secondary bodies 12 and 40 are engaged and rotate together. As shown in FIG. 1 and described above, such a configuration may be used to impart rotational force and motion to loosen a fastener (again, remembering that FIG. 1 is a bottom view of the wrench looking at the driving member).

Alternatively to that shown in FIG. 1, the pivot member 90, and thus the cam portion 230, may pivot in a second pivot direction (or clockwise in FIG. 1), causing the toggle 218 to pivot in a second toggle direction (or counterclockwise in FIG. 1), opposite that of the pivot direction. As the toggle 218 pivots in the second toggle direction, the pusher member 220 of the toggle would contact and dislodge the reverse bearing 80 from the reverse narrowing ends 66 or 72 of the spaces 62 or 63. Thus, the reverse bearing 80 would be prevented from binding by the toggle 218.

As the primary body 12 rotates with respect to the secondary body 40 in the first rotational direction 83, it would rotate independently of the secondary body 40, or rotate freely, because the toggle 218 prevents the reverse bearing 80 from binding. As the primary body 12 rotates with respect to the secondary body 40 in the second rotational direction 85, the forward bearing 82 would bind in the forward ends 68 or 74 of the spaces 62 or 63 between primary and secondary walls 32 and 42. Thus, the primary and secondary bodies 12 and 40 would engage and rotate together. Thus, opposite to that shown in FIG. 1 and described above, such a configuration may be used to drive, or tighten, a fastener.

The toggle 218 is an example of a displacement means for selectively displacing one of the bearings 80 or 82 from the narrowing sections or ends 66 or 68 to prevent one of the bearings from binding.

Again as shown in FIG. 1, a pair of toggles 218 may be disposed to extend into the cavity 30 of the primary body 12, or into the space 60 between the primary and secondary walls 32 and 42. A first toggle 250 defines a reverse toggle and projects into the space 63 near the reverse end 72. A second toggle 252 defines a forward toggle and projects into the space 62 near the forward end 74. The reverse toggle 250 contacts or engages the reverse bearing 80 to displace or dislodge the bearing 80 from the reverse narrowing end 72. Likewise, the forward toggle 252 contacts the forward bearing 82 to dislodge the bearing 82 from the forward narrowing end 74. Thus, the toggles 250 and 252 each prevent either the reverse or forward bearings 80 and 82, respectively, from binding in the narrowing ends 72 and 74 between the primary and secondary bodies 12 and 40.

It will be appreciated that the operation of the wrench device 10 is similar whether one toggle 218 or two toggles 250 and 252 are used. If multiple bearing pairs are used, the difference is mostly conceptual. The toggles may be conceptualized as operating between a pair of bearings or on either side of a bearing pair.

Referring now to FIG. 6, the wrench device 10 is shown in an exploded view to illustrate the various components. The wrench device 10 has a main or primary body 12, and an engagement cam or secondary body 40 with an integral drive member 50. The device 10 also has a pivot member 90 with a cam portion 230. The device 10 has a plurality of springs 88 and bearings 80 and 82. The device 10 also has a plurality of toggles 218 and a plurality of pivot pins 224. In addition, the toggle 218 may have other configurations, such as a hammer-shaped head formed on one end.

As indicated above, the bearings 80 and 82 engage immediately to bind the primary and secondary bodies 12 and 40 together to rotate in one direction, while turning freely in the opposite direction. Thus, the wrench 10, or bearing-type clutch, has a small arc swing, preferably less than approximately 4 degrees. It has been discovered, however, that a wrench 10, or bearing-type clutch, with the above described configuration may roll as torque increases. At higher torques, for example over 80 ft lbs, the bearings may roll excessively or unacceptably. (It is of course understood that the arc swing and torque vary depending on the size of bearing, the geometry of the space, etc.) Therefore, the wrench 10 advantageously also includes the ratchet mechanism 24.

The ratchet mechanism 24 includes a pawl 300 which selectively engages the plurality of teeth 36 to further engage or bind the primary and secondary bodies 12 and 30, preferably at higher torques. As stated above, the primary body 12 preferably has a plurality of teeth 36 which can be located in the cavity 30 forming a toothed section or wall 34 circumscribing the cavity 30. The pawl 300 preferably is pivotally coupled to the secondary body or engagement cam 40. The pawl 300 itself has one or more teeth 302 formed at each end thereof, or on each of a pair of opposing wings or arms 304 and 306. A pair of spherical bearings 308 may be disposed on each side of the pawl 300 to pivotally couple the pawl 300 to the secondary body 40, and about which the pawl 300 pivots. Alternatively, a pivot pin may be used.

The teeth 302 on each end of the pawl 300 are angled to have one blunt face or edge which abuts to the teeth 36 of the cavity 300 to prevent rotation in one direction (such as counterclockwise as shown in FIGS. 1 and 5), and another angled face or edge which slides past the teeth 36 of the cavity 300 to allow rotation in the opposite direction (such as clockwise as shown in FIGS. 1 and 5).

The pawl 300 is selectively pivotable to engage the teeth 302 of one of the arms or wings 304 and 306 with the teeth 36 of the cavity 30. The teeth 302 of the first arm or wing 304 are configured to allow rotation of primary body 12 in the second or forward rotational direction 85, but prevent rotation of the primary body 12 in the first or reverse rotational direction 83, when the pawl 300 is pivoted so that the first arm or wing 304 engages the teeth 36 of the cavity 30, as shown in FIGS. 1 and 5. Oppositely, the teeth 302 of the second arm or wing 306 are configured to allow rotation of the primary body 12 in the first or reverse rotational direction 83, but prevent rotation of the primary body 12 in the second or forward rotational direction 85. Thus, the direction of binding or turning can be controlled by selectively pivoting the pawl 300.

In addition, the pawl 300 is pivotable between a slip position and an engagement position. In the slip position, the pawl 300, or wing 304 or 306 pivots away from the teeth 36 of the cavity 30 to allow the teeth 36 to slide past in one direction. In the engagement position, the pawl 300, or teeth 302 of one of the wings 304 or 306, engages the teeth 36 of the cavity 30 in the other direction.

The pivotal position of the pawl 300 advantageously is controlled by the same switch 90 which controls the toggles 218 and bearings 80 and 82. Thus, turning the switch 90 orients both the toggles 218 and bearings 80 and 82, and the pawl 300. The switch 90, protrusion 110, or cam portion 230 includes a bore 312 receiving a spring 314 and a detent member 316. Thus, the detent member 316 pivots or turns with the switch 90. The detent member 316 is located to engage the pawl 300 opposite the teeth 302 such that the spring 314 pushes the detent member 316 against one of the wings 304 or 306 of the pawl 300, to push the teeth 302 of one of the wings 304 or 306 against the teeth 36 of the cavity 30. The spring 314 also allows the pawl 300 to pivot so that the teeth 302 of the pawl 300 may pivot back away from the teeth 36 of the cavity 30 in the free direction.

Referring again to FIG. 7*b,* the primary body 12 has two sections or layers, the smooth wall section 32 and the toothed section 34. Similarly, referring to FIG. 8*a,* the secondary body or engagement cam 40 also has two sections or layers, a smoothed wall section with the wall 42 opposing the smooth wall section 32 of the primary body 12, and a pawl section with the pawl 300 opposing the toothed section 34. Again, referring to FIG. 9*c,* the switch 90 also has two sections or layers, a cam section corresponding to the smooth wall section 32 of the primary body 12 and smooth wall section of the secondary body 40 for engaging the toggles 218 and thus the bearings 80 and 82, and a detent section corresponding to the toothed section 34 of the primary body 12 and pawl section of the secondary body 40 for engaging the pawl 300.

Figure 3:
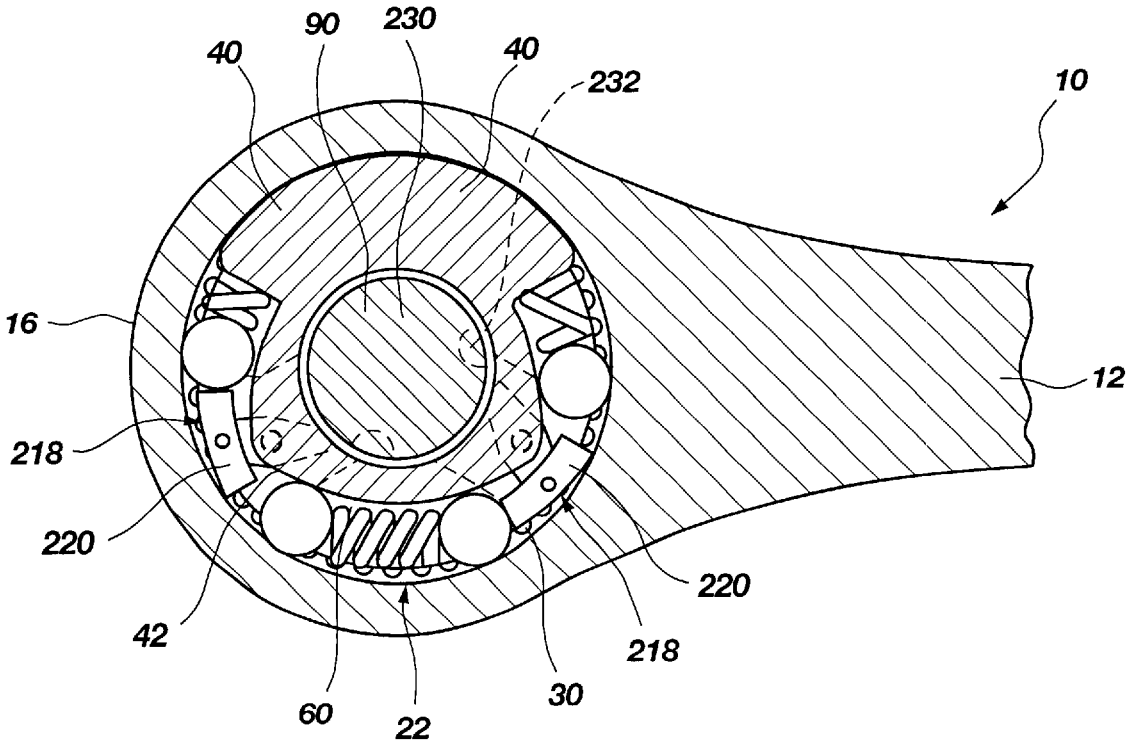
FIG. 3 is a bottom, cross sectional view of the wrench device of FIG. 1 taken along line 3—3.

Referring to FIG. 3, the smooth wall section of the secondary body 40 is shaped with the secondary wall 42 forming the space 60 on one side, and a lobe on the other side to abut the wall 32 of the cavity. Alternatively, the secondary body 40 can be shaped to create a space surrounding the body, such that bearings and toggles may be disposed completely around the body.

Referring to FIG. 5, the pawl section of the secondary body 40 also has a shape with a wall which bears against the teeth 36 of the cavity 30 opposite the pawl 300. Alternatively, multiple pawls may be formed around the body.

As stated above, the bearings 80 and 82 bind instantly as the primary body 12 is rotated in a first direction (such as clockwise or in the first reverse rotational direction 83 shown in FIG. 1), but allow the primary body 12 to rotate freely in an opposite second direction (such as counterclockwise or in the second forward rotational direction 85 shown in FIG. 1). Thus, the wrench 10 has a small arc swing, or can be rotated freely in the second direction through a small arc swing, or the bearings 80 and 82 bind in the first direction through a small arc swing. The arc swing of the bearing clutch 22 can be less than the arc swing of the ratchet mechanism 24. For example, with forty-five teeth 36, the arc swing of the ratchet mechanism 24 is 8 degrees. Thus, the bearing clutch 22 of the wrench 10 may be used in situations of limited movement. Also as stated above, however, the bearing clutch 22 may roll at high torques, at which time the ratchet mechanism 24 advantageously would engage to prevent further roll of the secondary body.

The engagement bearings 80 and 82 selectively binding between the primary and secondary walls 32 and 42 are one example of an engagement means. It is of course understood that any type or shape of bearing may be used, such as spherical, cylindrical, non-cylindrical, etc. The reverse bearing 80 responds to a first reverse rotational movement 83 of the primary body 12 to fixedly engage the primary body 12 and the secondary body 40 in a first fixed relationship with the primary body 12 in a first relative position. The reverse bearing 80 responds to an amount of a second forward rotational movement 85, to disengage the primary body 12 and secondary body 40.

The reverse bearing 80 again responds to a first reverse rotational movement 83 of the primary body 12, regardless of the amount of the second forward rotational movement 85, or arc swing $\theta_b$, to fixedly re-engage the primary body 12 and the secondary body 40 in a second relative position with the primary body 12 in a second relative position. The wrench device 10 of the present invention presents a significant improvement over prior art ratchet wrenches which require a discrete or finite amount of reverse rotational movement before re-engaging in a second relative position.

Thus, the bearing clutch 22 or bearing 80 has an arc swing $\theta_b$ which is relatively small. The ratchet mechanism 24, or pawl 300 and teeth 36, have a larger arc swing $\theta_p$ than the arc swing $\theta_b$ of the bearing 80. For example, if the wrench 10 has 45 teeth 36, as shown, the ratchet mechanism 24 or pawl 300 has as arc swing $\theta_p$ of 8 degrees. Thus, the primary body 12 of the wrench 10 must rotate through an arc swing $\theta_p$ of 8 degrees before the pawl 300 can engage another tooth 36. With the bearing clutch 22 or bearing 80, the wrench can rotate through an arc swing $\theta_b$ less than the arc swing $\theta_p$ of the pawl 300 for the bearing 80 to re-bind.

At increased torque, however, the bearing clutch 22 or bearing 80 may roll, indicated at 340. The amount or degree that the bearing clutch 22 or bearing 80 may roll 340 is limited or prevented by the ratchet mechanism 24 or pawl 300. For example, as the bearing clutch 22 or bearing 80 rolls 340, the pawl 300 engages and/or abuts the teeth 36, preventing further rotation of the primary body 12.

The wrench device 10 of the present invention presents a main body and cam, or primary and secondary bodies 12 and 40, with an infinite number of engagement points. There are an infinite number of engagement points around the circumference of the cavity and cam walls, or primary and secondary walls 32 and 42, where the bearings 80 and 82 may bind, and thus, an infinite number of fixed relationships between the primary and secondary bodies 12 and 40.

The wrench device 10 of the present invention presents a primary body 12 which instantaneously engages the secondary body 40 and drive member 50 upon the application of rotational movement in the appropriate direction. As the primary body 12 rotates in the forward rotational direction 85 the forward bearing 82 immediately binds between the primary and secondary walls 32 and 42 to immediately engage the primary body 12 and secondary body 40. The reverse bearing 80 likewise immediately binds between the primary and secondary walls 32 and 42 when the primary body 12 rotates in the reverse rotational direction 83 to immediately engage the primary and secondary bodies 12 and 40.

In accordance with the features and combinations described above, a method of driving and/or removing a fastener using the wrench device described above includes coupling an appropriately sized socket to the drive member of the device and the fastener. The socket has a first cavity sized and configured for engaging a fastener and a second cavity sized and configured for receiving the drive member.

To drive, or tighten, the fastener, the pivot member or lever switch is pivoted in a first pivot direction, which may be clockwise or counter clockwise depending on the pivot member or lever switch used. Pivoting the pivot member causes the pins or toggles to contact and dislodge the reverse bearings from the reverse sections of the nonuniform space.

The main body is then rotated in a second forward rotational direction 85. As the main body is rotated in the second forward rotational direction 85, the forward bearings bind in the forward sections of the nonuniform space between the cavity and cam walls. The forward bearings bind instantly as the main body rotates. As the forward bearings bind, the main body and cam fixedly engage in a first fixed relationship with the main body in a first relative position with respect to the cam. As the main body and cam rotate together in the second forward rotational direction, the fastener is tightened.

As the main body is rotated in the first reverse rotational direction 83, the forward bearings move back slightly from the forward sections of the space and slide along the walls. The main body and cam disengage instantly as the main body rotates. Only a small amount of rotational movement in the first reverse rotational direction is required for the main body and cam to disengage. As the main body rotates in the first reverse rotational direction, it rotates independently of the cam.

As the main body is again rotated in the second forward rotational direction, the forward bearings again instantly bind between the walls, re-engaging the main body and cam. The main body and cam are fixedly re-engaged in a second fixed relationship with the main body in a second relative position. In addition, the main body and cam re-engage regardless of the amount of rotation of the main body in the first reverse rotational direction. Therefore, the device may be used in very tight spaces where angular or rotational movement of the main body is severely restricted because the bearings reengage the main body and cam in a second relative position regardless of the amount of rotation of the main body in the first reverse rotational direction.

To loosen the fastener, the pivot member or lever switch is pivoted in the second pivot direction. As the pivot member pivots, the pins or toggles contact and dislodge the forward bearings from the forward narrowing sections of the space. The operation of the device is then similar as that described above only in opposite directions.

Figure 10:
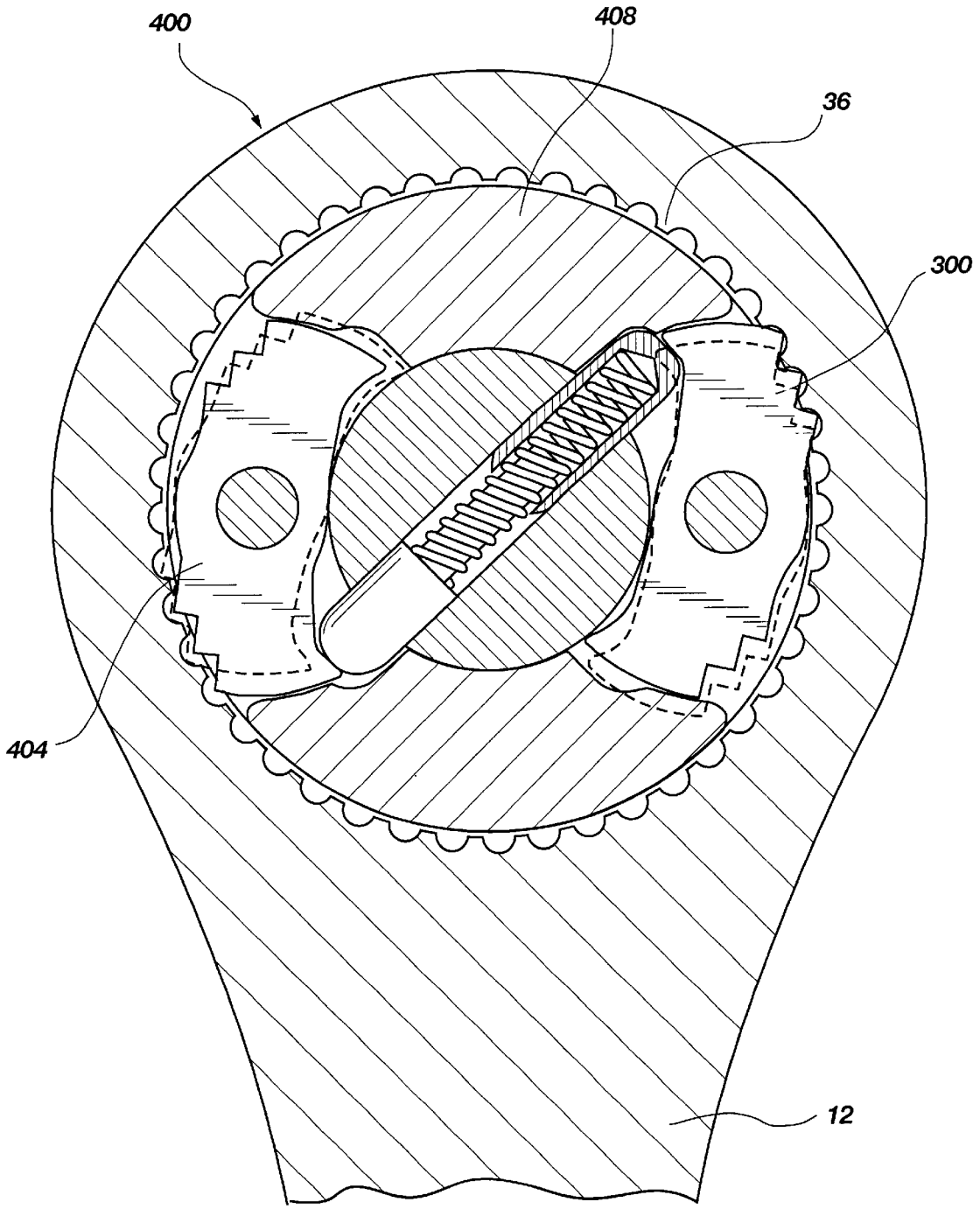
FIG. 10 is bottom, cross-sectional view of another wrench device in accordance with the present invention.

Referring now to FIG. 10, another wrench device 400 is shown which is similar in most respects to the wrench 10 described above. The wrench 400 advantageously includes a pair of pawls, such as first and second pawls 300 and 404. The pawls 300 and 404 may be pivotally disposed opposite one another on a secondary body 408. The function and structure of the pawls 300 and 404 is similar to the pawl 300 described above. Preferably, the pawls 300 and 404 are located with respect to one another and the teeth 36 to abut the teeth 36 at different rotational orientations between the bodies 12 and 408, such that the pawls 300 and 404 alternately engage and/or abut the teeth 36. For example, the pawls 300 and 404 may be located opposite one another, and the wrench 400 may have an odd number of teeth 36, such as 45 as shown. Thus, only one pawl, such as the first pawl 300, engages and/or abuts the teeth 36, while the other pawl, such as the second pawl 404, does not engage or abut the teeth 36, as shown by the pawls 300 and 404 in solid lines. As the primary and secondary bodies 12 and 408 rotate with respect to one another, the other pawl, or second pawl 404, engages and/or abuts the teeth 36, while the one pawl, or first pawl 300, does not engage or abut the teeth 36, as shown by the pawls 300 and 404 in dashed lines. The dashed lines represent four degree rotational movement.

Thus, the first pawl 300 is disposed to abut the teeth 36 at a first rotational orientation between the bodies 12 and 408, shown by pawl 300 in solid lines. The second pawl 404 is disposed to abut the teeth 36 in a second rotational orientation between the bodies 12 and 408, shown by pawl 404 in dashed lines. Referring to FIGS. 12*a–f*, the wrench device 400 is shown with the primary and secondary bodies 12 and 408 at different angular orientations with respect to one another. As the bodies 12 and 408 rotate with respect to one another, the pawls 300 and 404 alternately engage the teeth 36. For example, it will be noted that each single pawl 300 and 404 engages the teeth 36 in eight degree increments, while together the pawls 300 and 404 alternately engage in four degree increments.

The result of the two pawls 300 and 404 advantageously is to reduce the arc swing $\theta_p$ of the ratchet 24 or pawls. For example, as described above, 45 teeth 36 result in an arc swing $\theta_p$ of 8 degrees, or the primary and secondary bodies 12 and 408 must rotate through 8 degrees before the pawl 300 engages a different tooth 36. The use of the two pawls 300 and 404 arranged as described, however, reduces the arc swing $\theta_p$ of the wrench to four degrees because the two pawls 300 and 404, each with an individual arc swing $\theta_p$ of eight degrees, overlap, or alternate engaging or abutting the teeth 36.

As described above, an odd number of teeth 36 with used while the pawls 300 and 404 were aligned, resulting in pawls 300 and 404 which alternate engagement of the teeth 36. It is of course understood that an even number of teeth 36 may be used while the pawls 300 and 404 may be misaligned with the same result. In addition, it is understood that any number of pawls may be used, such as three, to further reduce the arc swing $\theta_p$ of the wrench 400. Furthermore, it is understood that pawls may be grouped in sets, such as pairs.

Thus, each single pawl 300 or 404 abuts the teeth 36 at rotational intervals equaling 360 degrees divided by the number of teeth 36, which equals the arc swing of each single pawl 300 or 404. The pawls 300 and 404 together, however, abut the teeth 36 at rotational intervals equaling at least half of a single pawl, reducing the arc swing of the ratchet mechanism 24 in half. The pair of pawls 300 and 404 advantageously reduces the arc swing of the wrench 400, and allows the teeth 36 to be larger and stronger, and thus capable of withstanding greater torque.

Figure 11:
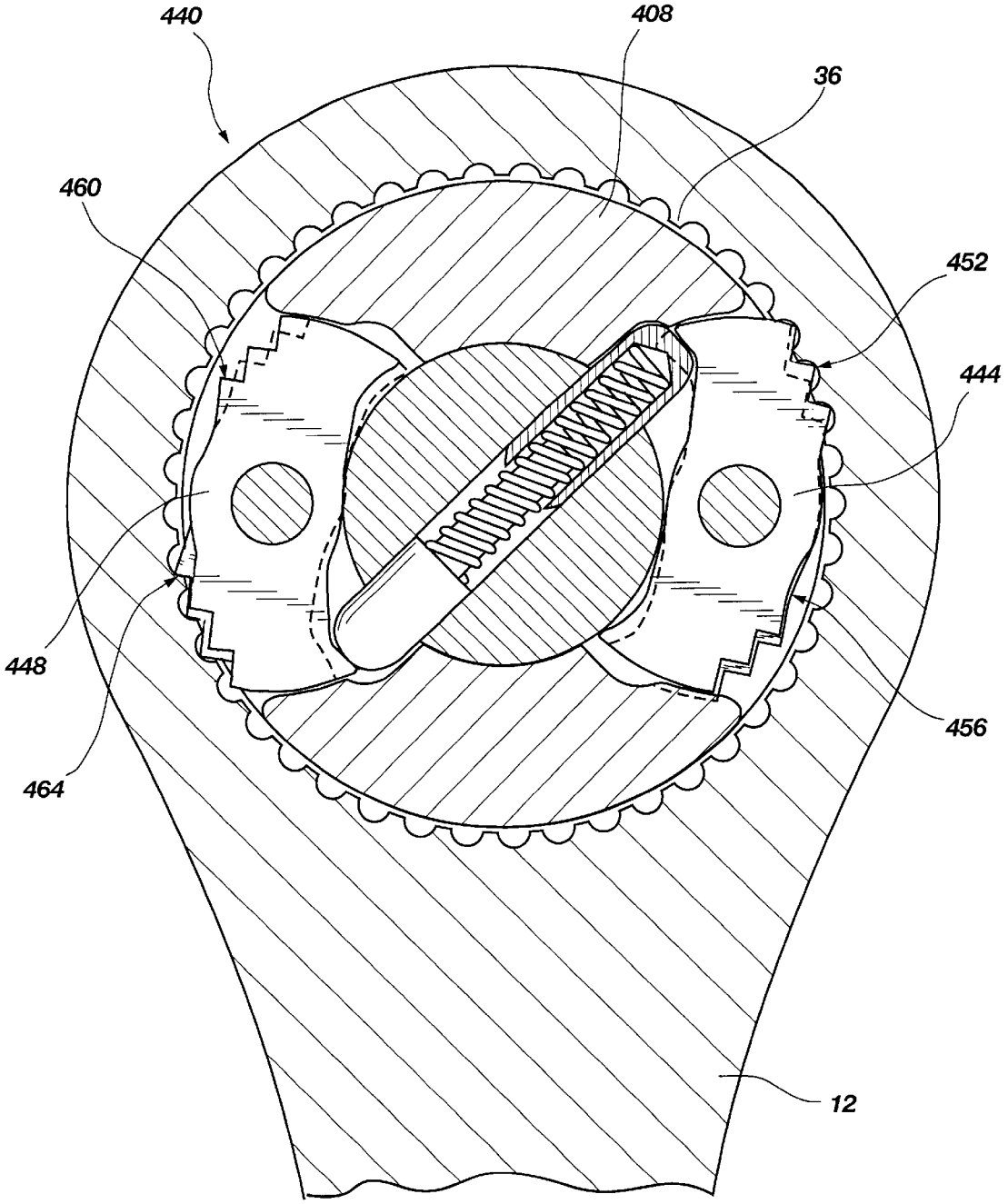
FIG. 11 is bottom, cross-sectional view of another wrench device in accordance with the present invention.
Figure 12C:
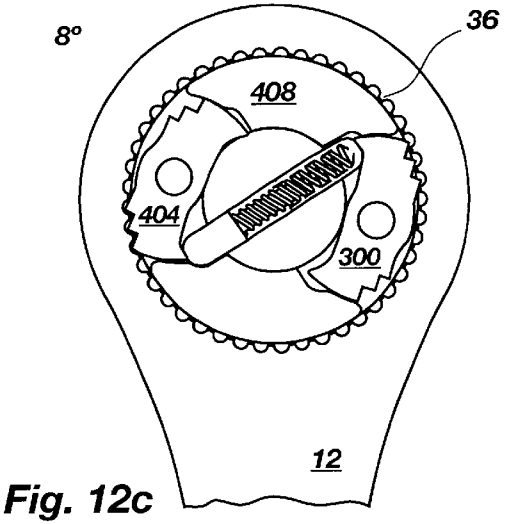
FIGS. 12*a–f* are schematic views of the wrench device of FIG. 10.
Figure 12B:
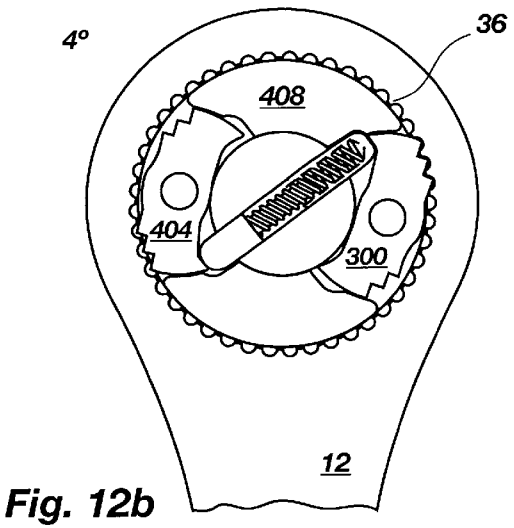
Figure 12A:
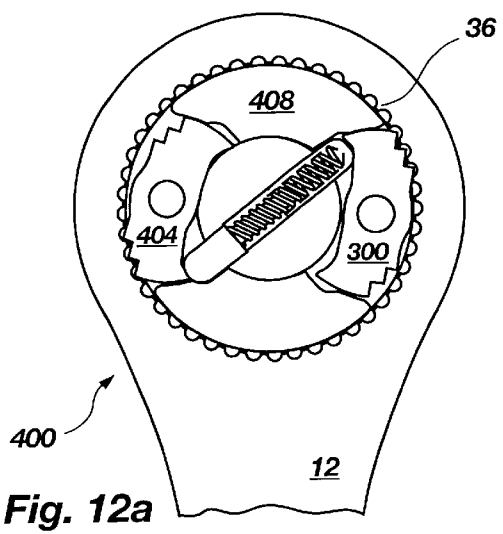
Figure 12F:
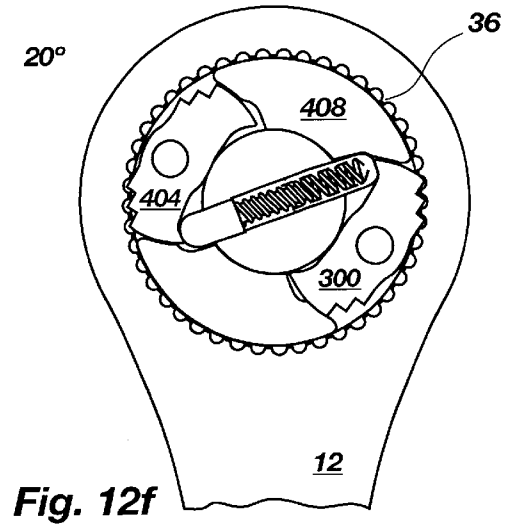
Figure 12E:
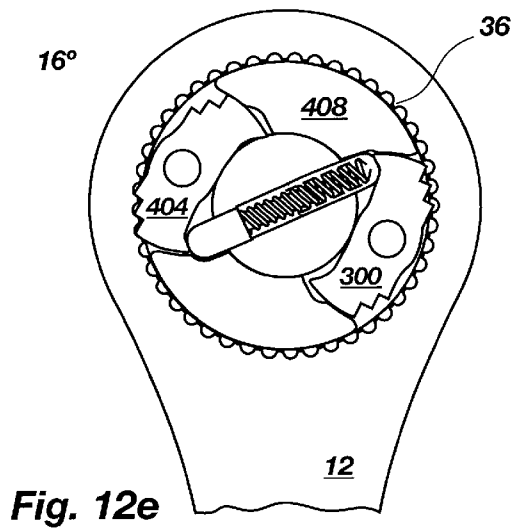
Figure 12D:
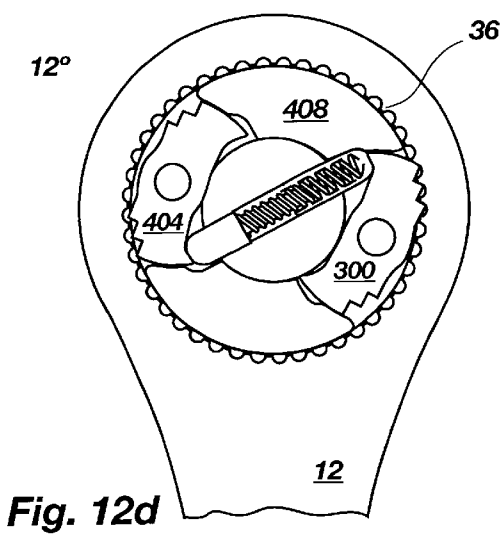

Referring to FIG. 11, another wrench 440 is shown which is similar in most respect to the wrenches 10 and 400 described above. The wrench 440 includes first and second pawls 444 and 448. Each pawl 444 and 448 is split, or includes a pair of pawls. The first pawl 444 includes first and second pawl halves 452 and 456. Similarly, the second pawl 448 includes first and second pawl halves 460 and 464. The pawl halves of each pawl 444 and 448 are disposed to abut the teeth 36 at different rotational orientations between the bodies 12 and 408, such that the pawl halves of each pawl 300 and 404 alternately engage and/or abut the teeth 36.

It will be noted that a wrench device may utilize only the pawl or pawls. Thus, such a wrench can have a pair of pawls, as described above, to reduce the arc swing of the wrench, and/or to have larger and stronger teeth.

Although the engagement bearings above have been shown as cylindrical-type bearings, it is of course understood that any type of bearing may be used. For example, the engagement bearings may be ball bearings, barrel bearings, pin bearings, roller bearings, etc. In addition, the bearings may be circular or non-circular. The engagement bearings may be of any appropriate length or diameter.

In addition, although the present invention has been illustrated and described with particular reference to a wrench device, it is of course understood that the present invention may be applied to any primary and secondary bodies for reversibly and selectively engaging the bodies. For example, a screwdriver device, fishing reel, bike, etc. may also use the principals of the present invention.

It will be appreciated that the structures and apparatus disclosed herein are merely exemplary of engagement means for engaging the primary and secondary bodies, and displacement means for dislodging the bearings, and it should be appreciated that any structure, apparatus or system for engaging and/or displacing which performs functions the same as, or equivalent to, those disclosed herein are intended to fall within the scope of a means for engaging and a means for displacing, including those structures, apparatus or systems for engaging and/or displacing which are presently known, or which may become available in the future. Anything which functions the same as, or equivalently to, a means for engaging or means for displacing falls within the scope of this element.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment (s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A wrench device, comprising:

a) a primary body having a primary wall;

b) a secondary body, rotatably coupled to the primary body, having a secondary wall generally opposing the primary wall;

c) at least one tapering space, formed between the primary and secondary walls;

d) at least one bearing, movably disposed in the tapering space, and movably between: 1) a free location to allow the secondary body to rotate with respect to the primary body, and 2) a binding location in which the bearing binds between the primary and secondary walls to cause the primary and secondary bodies to rotate together;

e) a plurality of teeth, formed on one of the primary or secondary bodies; and f) a pawl, pivotally disposed on the other of the primary or secondary bodies to engage the plurality of teeth, and pivotal between: 1) a slip position in which the teeth slide past the pawl to allow the secondary body to rotate with respect to the primary body, and 2) an engagement position in which the pawl engages in the teeth to cause the primary and secondary bodies to rotate together.

2. A device in accordance with claim 1, wherein the bearing binds in the binding location with when a torque is applied between the bodies, but rolls when a higher torque is applied with increase; and wherein the pawl engages the teeth in the engagement position when the higher torque is applied.

3. A device in accordance with claim 1, wherein the pawl and the tapering space with the bearing are disposed at opposite sides of the secondary body.

4. A device in accordance with claim 1, wherein the primary body further includes a cavity with a smooth wall section and a toothed section with a plurality of teeth, both sections circumscribing the cavity; and wherein the secondary body is disposed in the cavity of the primary body, and further includes a smooth wall section opposing the smooth wall section of the primary body and circumscribing the secondary body.

5. A device in accordance with claim 1, wherein the bearing has an arc swing; and wherein the pawl has a larger arc swing than the bearing.

6. A device in accordance with claim 1, wherein the bearing (i) fixedly engages the primary and secondary bodies in a first fixed relationship with the primary body in a first relative position, responsive to rotational movement of the primary body in a first rotational direction, (ii) disengages the primary and secondary bodies, responsive to an amount of rotational movement of the primary body in a second rotational direction, and (iii) fixedly re-engages the primary and secondary bodies in a second fixed relationship with the primary body in a second relative position, responsive to rotational movement of the primary body in the first rotational direction and regardless of the amount of rotational movement of the primary body in the second rotational direction.

7. A device in accordance with claim 1, further comprising:

displacement means for displacing the bearing from the binding location to the free location.

8. A device in accordance with claim 1, further comprising:

a) a pivot member, pivotally coupled to the primary body;

b) a swivel link, engaged by the pivot member and pivotally coupled to the secondary body; and c) a pusher member, pivotally disposed on the end of the swivel link, to engage and dislodge the bearing.

9. A device in accordance with claim 1, further comprising:

biasing means, disposed between the primary and secondary bodies, for biasing the bearing towards the tapering space, and towards the binding location.

10. A device in accordance with claim 1, further comprising:

a) at least two tapering spaces, formed between the primary and secondary bodies, including first and second tapering spaces tapering in opposite directions;

b) at least two bearings, each movably disposed in one of the at least two tapering spaces, including first and second bearings disposed in the respective first and second tapering spaces; and c) displacement means for selectively displacing one of the first and second bearings from the binding location to the free location, to prevent the displaced bearing from binding, such that displacement of the first bearing from the first tapering space allows the primary body to rotate independently with respect to the secondary body in a second rotational direction, and such that displacement of the second bearing from the second tapering space allows the primary body to rotate independently with respect to the secondary body in a first rotational direction.

11. A device in accordance with claim 1, wherein the pawl includes:

a) at least two pawls disposed to abut the teeth at such that the pawls alternately abut the teeth.

12. A device in accordance with claim 11, wherein the at least two pawls include first and second pawls, disposed so that the first pawl abuts the teeth at a first rotational orientation between the bodies, and the second pawl abuts the teeth in a second rotational orientation between the bodies, such that each single pawl abuts the teeth at rotational intervals equaling 360 degrees divided by the number of teeth, the pawls together abutting the teeth at rotational intervals equaling at least half of a single pawl.

13. A wrench device, comprising:

a) a secondary body rotatably coupled to a primary body forming at least one tapering space there between, and at least one of the bodies having a plurality of teeth;

b) at least one bearing, disposed in the tapering space, and movably between: 1) a free location, and 2) a binding location; and c) a pawl, pivotally coupled to one body, and pivotable between: 1) a slip position, and 2) an engaging position in which the pawl engages the plurality of teeth on the other body.

14. A device in accordance with claim 13, wherein the bearing binds in the binding location when a torque is applied between the bodies, but rolls when a higher torque is applied; and wherein the pawl engages the teeth in the engagement position when the higher torque is applied.

15. A device in accordance with claim 13, wherein the primary body further includes a cavity with a smooth wall section and a toothed section with a plurality of teeth, both sections circumscribing the cavity; and wherein the secondary body is disposed in the cavity of the primary body, and further includes a smooth wall section opposing the smooth wall section of the primary body and circumscribing the secondary body.

16. A device in accordance with claim 13, wherein the bearing has an arc swing; and wherein the pawl has a larger arc swing.

17. A device in accordance with claim 13, further comprising:

displacement means for displacing the bearing from the binding location to the free location.

18. A device in accordance with claim 13, further comprising:

a) a pivot member, pivotally coupled to the primary body;

b) a swivel link, engaged by the pivot member and pivotally coupled to the secondary body; and c) a pusher member, pivotally disposed on the end of the swivel link, to engage and dislodge the bearing.

19. A device in accordance with claim 13, further comprising:

biasing means, disposed between the primary and secondary bodies, for biasing the bearing towards the tapering space, and towards the binding location.

20. A device in accordance with claim 13, further comprising:

a) at least two tapering spaces, formed between the primary and secondary bodies, including first and second tapering spaces tapering in opposite directions;

b) at least two bearings, each movably disposed in one of the at least two tapering spaces, including first and second bearings disposed in the respective first and second tapering spaces, and each movably disposed in the tapering sections, the first and second bearings each being selectively movable between binding and free locations; and c) displacement means for selectively displacing one of the first and second bearings from the binding location to the free location, to prevent the displaced bearing from binding, such that displacement of the first bearing from the first tapering space allows the primary body to rotate independently with respect to the secondary body in a second rotational direction, and such that displacement of the second bearing from the second tapering space allows the primary body to rotate independently with respect to the secondary body in a first rotational direction.

21. A device in accordance with claim 13, wherein the pawl includes:

a) at least two pawls disposed to abut the teeth at different rotational orientations between the bodies such that the pawls alternately abut the teeth.

22. A device in accordance with claim 21, wherein the at least two pawls include first and second pawls, disposed so that the first pawl abuts the teeth at a first rotational orientation between the bodies, and the second pawl abuts the teeth in a second rotational orientation between the bodies, such that each single pawl abuts the teeth at rotational intervals equaling 360 degrees divided by the number of teeth, the pawls together abutting the teeth at rotational intervals equaling at least half of a single pawl.

23. A dual analog and ratchet wrench device, comprising:

a) an elongated body having a handle portion and a head portion with a cavity formed in the head portion, the cavity including a smooth wall section and a toothed section with a plurality of teeth, both sections circumscribing the cavity;

b) an engagement cam, rotatably disposed in the cavity of the handle, having means for engaging a socket or fastener, and a smooth wall section opposing the smooth wall section of the handle;

c) the smooth wall sections of the handle and engagement cam being sized and shaped to form at least one tapering space therebetween;

d) at least one bearing, movably disposed in the tapering space; and e) a pawl, pivotally coupled to the engagement cam opposing the toothed section of the handle.

24. A device in accordance with claim 23, wherein the bearing binds in the binding location when a torque is applied between the bodies, but rolls when a higher torque is applied; and wherein the pawl engages the teeth in the engagement position when the higher torque is applied.

25. A device in accordance with claim 23, wherein the bearing has an arc swing; and wherein the pawl has a larger arc swing.

26. A device in accordance with claim 23, further comprising:

displacement means for displacing the bearing from the binding location to the free location.

27. A device in accordance with claim 23, further comprising:

biasing means, disposed between the primary and secondary bodies, for biasing the bearing towards the binding location.

28. A device in accordance with claim 23, wherein the pawl includes:

a) at least two pawls disposed to abut the teeth at different rotational orientations between the bodies such that the pawls alternately abut the teeth.

29. A wrench device, comprising:

a) a secondary body rotatably coupled to a primary body, and at least one of the bodies having a plurality of teeth; and b) first and second pawls, each pivotally coupled to one body, and pivotable between: 1) a slip position, and 2) an engaging position in which the pawl engages the plurality of teeth on the other body; and c) the first and second pawls being disposed to abut the teeth at different rotational orientations between the bodies such that the first and second pawls alternately abut the teeth.

30. A device in accordance with claim 29, wherein the first and second pawls are disposed so that the first pawl abuts the teeth at a first rotational orientation between the bodies, and the second pawl abuts the teeth in a second rotational orientation between the bodies, such that each single pawl abuts the teeth at rotational intervals equaling 360 degrees divided by the number of teeth, the pawls together abutting the teeth at rotational intervals equaling at least half of a single pawl.

31. A device in accordance with claim 29, further comprising:

a) at least one bearing, disposed in a tapering space formed between the primary and secondary bodies, and movably between: 1) a free location, and 2) a binding location.

* * * * *